United States Patent [19]

Auracher

[11] Patent Number: 4,692,720

[45] Date of Patent: Sep. 8, 1987

[54] ARRANGEMENT FOR PRODUCING A JUNCTION BETWEEN A MICROSTRIP LINE AND A COPLANAR TRANSMISSION LINE

[75] Inventor: Franz Auracher, Baierbrunn, Fed. Rep. of Germany

[73] Assignee: Siemens Aktiengesellschaft, Berlin and Munich, Fed. Rep. of Germany

[21] Appl. No.: 717,116

[22] Filed: Mar. 28, 1985

[30] Foreign Application Priority Data

Jun. 1, 1984 [DE] Fed. Rep. of Germany ..... 3420599

[51] Int. Cl.[4] ..... H01P 5/08

[52] U.S. Cl. ..... 333/33; 333/26; 333/34; 333/246

[58] Field of Search ..... 333/33, 26, 21 R, 246, 333/34

[56] References Cited

U.S. PATENT DOCUMENTS

| | | | |
|---|---|---|---|
| 2,825,875 | 3/1958 | Arditi | 333/21 R X |
| 3,755,759 | 8/1973 | Cohn | 333/21 R |
| 3,784,933 | 1/1974 | Schrerer et al. | 333/34 X |
| 4,085,391 | 4/1978 | Schiek et al. | 333/33 |

FOREIGN PATENT DOCUMENTS

| | | | |
|---|---|---|---|
| 0087901 | 7/1981 | Japan | 333/246 |

*Primary Examiner*—Eugene R. Laroche
*Assistant Examiner*—Benny Lee
*Attorney, Agent, or Firm*—Hill, Van Santen, Steadman & Simpson

[57] ABSTRACT

An arrangement for producing a broadband junction between a microstrip line and a coplanar transmission line in the following called "twin band line" provides that the microstrip line and the twin band line (ZL) extend at right angles relative to one another. The ground electrode of the microstrip line and the ground electrode of the twin band line lie immediately one on top of the other. The strip-shaped other electrodes of the microstrip line and the narrower strip-shaped electrode of the asymmetrical twin band line which extends at right angles thereto and coplanar to the wider ground electrode of the twin band line are connected to one another in a broadband manner by one or more ribbons or wires of metal. The arrangement is advantageously employable as a fast integrated optical modulator with cutoff frequencies in the GHz range, whereby the spacing between the coplanar electrodes expediently constricts conically in the longitudinal direction thereof. The arrangement is also advantageously employable for connecting a twin band line to the rigid inner conductor of a coaxial cable.

3 Claims, 3 Drawing Figures

ARRANGEMENT FOR PRODUCING A JUNCTION BETWEEN A MICROSTRIP LINE AND A COPLANAR TRANSMISSION LINE

BACKGROUND OF THE INVENTION

1. Field of the Invention

The present invention relates to line junctions and more particularly to a junction structure connecting a microstrip line and a coplanar transmission line.

2. Description of the Prior Art

In addition to microstrip lines, coplanar transmission lines are also frequently employed in microwave circuits and in circuits of integrated optics, for example for the drive of fast electro-optical waveguide modulators. Both types of lines must often be connected to one another or to coaxial lines by way of broadband junctions. Broadband junctions between rigid coaxial lines and coplanar transmission lines, for example, are well known in the art. The junction from a rigid coaxial cable to, for example, a coplanar line in thin film circuits is technologically difficult, however, because of the required connection of the rigid inner conductor of the coaxial cable to the thin electrode of the coplanar line.

Junctions from coaxial plugs to microstrip lines on $Al_2O_3$ are commercially available.

SUMMARY OF THE INVENTION

The object of the present invention is to provide a simple arrangement for producing a broadband junction between a microstrip line and a coplanar transmission line, in the following text called "twin band line".

The above object is achieved, according to the present invention, in that the microstrip line and the coplanar twin band line extend at right angles relative to one another and are arranged such that the ground electrode of the microstrip line and the ground electrode of the twin band line lie one on top of the other and a strip-shaped further electrode of the microstrip line and a narrower electrode extends at right angles thereto and coplanar to the broader ground electrode of the twin band line which is thereby asymmetrical are connected to one another by one or more ribbons or wires of electrically-conductive material.

According to a preferred embodiment of the invention, the arrangement is designed such that the two ends of the narrower electrode of the asymmetrical twin band line are connected to respective strip electrodes of the microstrip line which extend at right angles thereto, being connected thereto by one or more ribbons or wires of electrically-conductive material that are disposed side-by-side.

A further preferred embodiment of the arrangement of the present invention is desined such that one or more strip electrodes of the microstrip line and their ground electrode are disposed on opposite sides of a thin substrate of electrically-insulating material and the two coplanar electrodes of the twin band line are arranged on one side of a substrate of dielectric material. According to a further feature of the invention, the substrate of the microstrip line preferably consists of ceramic material and the substrate of the twin band line consists of electro-optical material.

An advantageous emodiment of the arrangement constructed in accordance with the present invention, which can be employed as a fast, integrated optical modulator, is fashioned such that the spacing between the two coplanar electrodes of the twin band line narrows in the longitudinal direction thereof, whereby the ratio between the width of the narrower electrode of the twin band line and the spacing between the two coplanar electrodes along these electrodes is kept constant. Given this embodiment of the invention, a larger spacing favorable for the broadband junction and a significantly smaller spacing between the coplanar electrodes of the twin band line which is favorable for a high limit frequency of the modulator in the GHz range are realizable at the same time.

According to another feature of the invention, the arrangement is advantageously used for producing a broadband junction between a coaxial line and a twin band line, whereby a junction between the coaxial line and the microstrip line is produced. This junction from the coaxial line, for example a coaxial cable, to the microstrip line can occur with commercially available components.

BRIEF DESCRIPTION OF THE DRAWINGS

Other objects, features and advantages of the invention, its organization, construction and operation will be best understood from the following description, taken in conjunction with the accompanying drawings, on which.

DESCRIPTION OF THE PREFERRED EMBODIMENT

Figure 1:
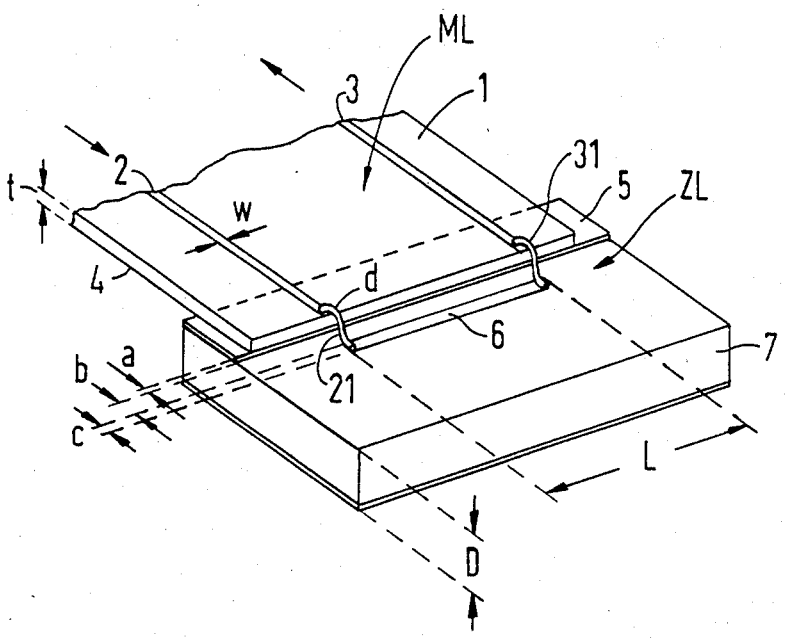
FIG. 1 is a perspective view of an asymmetrical coplanar twin band line whose opposite ends are respectively connected to a microstrip line by a broadband junction in accordance with the present invention.

Referring to FIG. 1, a twin band line ZL is formed of a broad, strip-shaped ground electrode 5 and a narrower strip-shaped electrode 6 of the upper side of a substrate 7 which is coplanar thereto. The underside of the substrate 7 can be additionally metallized and connected to ground. The characteristic impedance $Z_0$ of the twin band line is defined by the parameters c/b, b/D and by the dielectric constant $\epsilon_v$ of the material of the substrate 7. As seen, b is the spacing between the parallel extending strip-shaped electrodes 5 and 6 of the twin band line ZL, c is the width of the narrower electrode 6 of the twin band line ZL, D is the thickness of the substrate 7. For a substrate of $L_iNbO_3$ and $Z_0 = 50$ ohms, for example, the ratio c/b is approximately 0.6 when D is greater than b.

The microstrip line ML is applied, for example, to the substrate 1 of $Al_2O_3$ having a thickness t of about 0.6 mm. A ground electrode 4 is formed by the surface-wide metallization of the underside of the ceramic substrate 1 and the strip-shaped electrodes 2 and 3 are applied to the upper side in the form of metal strips having the width w which extends perpendicular to the narrower strip-shaped electrode 6 of the twin band line ZL. In the present case of the 0.6 mm thick substrate 1 of $Al_2O_3$, the width w of the electrodes 2 and 3 amounts to about 1.2 mm for a 50 ohm line. The broadband junction from the microstrip line ML to the twin band line ZL is achieved as follows. The underside of the microstrip line ML on which the ground electrode 4 is located is brought, for example by inserting a spring plate, into good electrical contact with the ground electrode 5 of the twin band line ZL on the surface of the substrate 7. The "hot" strip-shaped electrodes 2 and 3 of the microstrip line ML are connected via conductive ribbons or small wires 21 or, respectively, 31 to the "hot" electrode 6 of the twin band line ZL, for example by bonding, this "hot" electrode 6 being coplanar to the ground electrode 5.

The optimization of the broadband junction occurs by the proper selection of the dimensions a, b, c and d, of which a denotes the distance of the end of the microstrip line ML on the ground shell electrode 5 of the twin band line ZL from that edge of the broader ground electrode 5 lying opposite the coplanar, narrower electrode 6, and d denotes the width or the diameter of the ribbons or small wires 21, 31.

For the selected example of the 50 ohm microstrip line ML on a 0.6 mm thick substrate 1 of $Al_2O_3$ and the asymmetrical coplanar twin band line ZL on a 1.5 mm thick substrate of $LiNbO_3$, for example, the following dimensions have proven themselves optimum: a=0 through 0.5 mm; b approximately 0.25 mm and c/b about 0.6.

Figure 2:
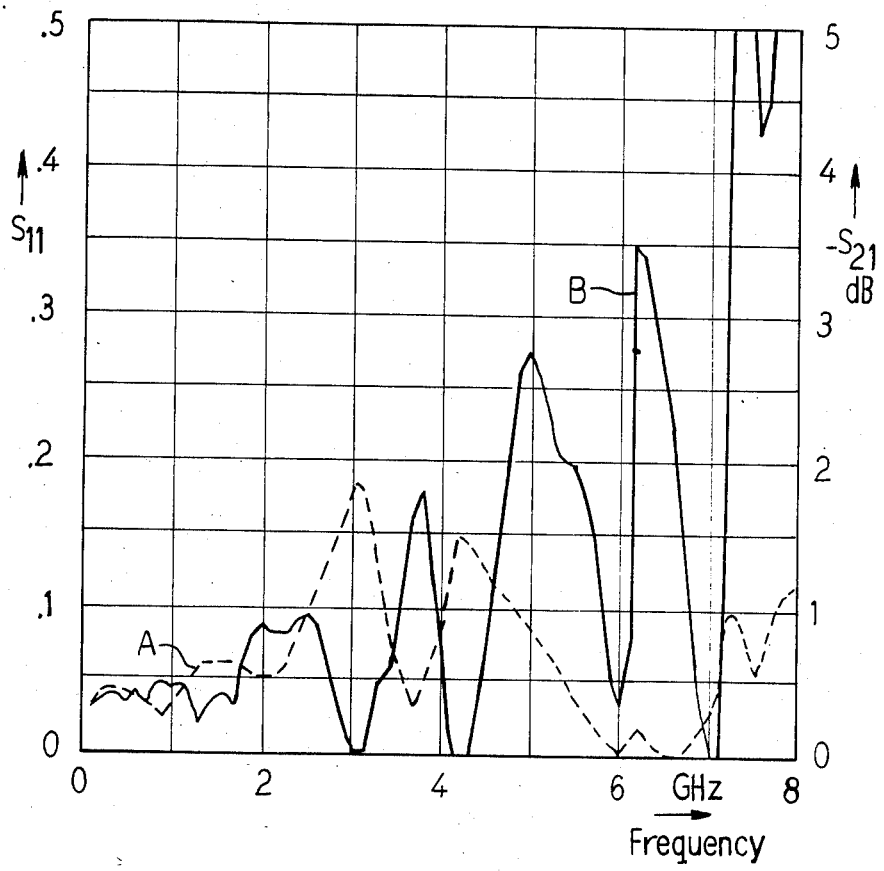
FIG. 2 is a graphic illustration of the frequency response of the reflection factor $S_{11}$ or, respectively, of the insertion loss $S_{21}$ measured in a specifically-dimensioned arrangement of FIG. 1.

Of the two curves A and B in FIG. 2, curve A shows the measured frequency response of the reflection factor $S_{11}$ of the strip-shaped electrode 2 of the microstrip line ML functioning as input and curve B shows the measured frequency response of the insertion loss $S_{21}$ for an arrangement dimensioned such wherein the length L of the "hot" electrode 6 of the twin band line ZL amounted to 13 mm and the width c thereof amounted to 120 μm given c/b=0.6, and wherein the strip-shaped electrode 3 of the microstrip line ML was terminated with 50 ohms. The width d of the bond ribbons 21 and 31 respectively amounted to 100 μm. The frequency response should be even significantly better given employment of wider ribbons or wires 21 and 31, for example having a width or a diameter d of 200–1000 μm.

Figure 1A:
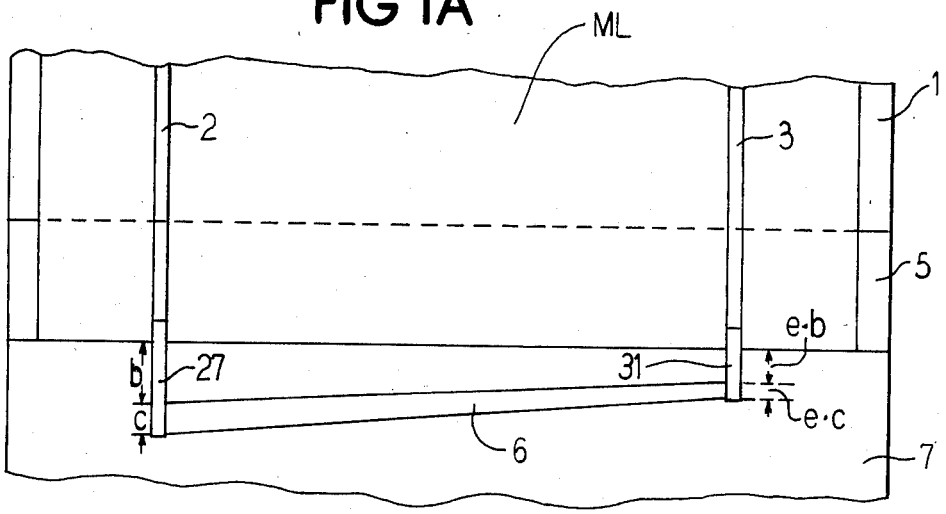
FIG. 1A is an enlarged fragmentary view illustrating a tapered structure in which the ratio of the width of an electrode to the spacing between that electrode and another ground electrode is maintained constant.

The described illustrative embodiment is typical for fast, integrated optical modulators. The spacing b between the coplanar electrodes 5 and 6 of the twin band line ZL in this case, however, should only amount to between 5 and 20 μm. The transition from the spacing of b 250 μm employed in the illustrative embodiment to spacings of 5 through 20 μm can then ensue simply by, for example, a taper-like constriction of the spacing between the coplanar electrodes 5 and 6 in longitudinal direction of these electrodes, whereby the ratio c/b along the electrodes 5 and 6 is kept constant as indicated by the dimensions e-b and e-c as illustrated in FIG. 1A. Modulators having a limit frequency of over 4 GHz given a length L of the hot electrode 6 of the twin band line ZL of 13 mm have already been tested according to this principle.

Although I have described my invention by reference to particular illustrative embodiments thereof, many changes and modifications of the invention may become apparent to those skilled in the art. I therefore intend to include within the patent warranted hereon all such changes and modifications as may reasonably and properly be included within the scope of my contribution to the art.

I claim:

1. A broadband junction structure for a microstrip line and a coplanar twin-band line, comprising:

first and second electrically-insulating substrates each including first and second spaced apart surfaces, all of said surfaces being in respective parallel spaced apart planes;

a first ground electrode carried on said first surface of said first substrate and a second ground electrode carried on said first surface of said second substrate, said first and second ground electrodes electrically contacting one another;

first and second spaced apart parallel strip electrodes on said second surface of said first substrate which together with said first ground electrode constitute a microstrip line, said strip electrodes extending perpendicular to said second ground electrode;

at least one narrow electrode on said first surface of said second substrate spaced from said second ground electrode, said at least one narrow electrode including opposite ends and together with said second ground electrode constituting a twin-band line; and first and second electrical connections respectively connecting said first and second strip electrodes to said opposite ends of said at least one narrow electrode.

2. The broadband junction structure of claim 1, wherein:

said substrate of said twin-band line comprises electro-optical material.

3. The broadband junction structure of claim 5, wherein:

said second ground electrode and said at least one narrow electrode which include edges which are spaced in a convergent relationship to provide a tapering of the space therebetween; and the ratio of the width of said at least one narrow electrode to the spacing between said at least one narrow electrode and said second ground electrode is constant.

* * * * *